US008764280B2

(12) United States Patent
Hillis et al.

(10) Patent No.: US 8,764,280 B2
(45) Date of Patent: Jul. 1, 2014

(54) TWO-PHASE DETACHED ESCAPEMENT MECHANISM FOR OSCILLATORS AND RELATED SYSTEMS

(75) Inventors: W. Daniel Hillis, Encino, CA (US); Luke Walter Khanlian, Granada Hills, CA (US)

(73) Assignee: The Long Now Foundation, San Francisco, CA (US)

( * ) Notice: Subject to any disclaimer, the term of this patent is extended or adjusted under 35 U.S.C. 154(b) by 523 days.

(21) Appl. No.: 13/103,779

(22) Filed: May 9, 2011

(65) Prior Publication Data

US 2011/0273968 A1 Nov. 10, 2011

Related U.S. Application Data

(60) Provisional application No. 61/333,142, filed on May 10, 2010.

(51) Int. Cl.

| | |
|---|---|
| ***G04B 15/00*** | (2006.01) |
| ***G04B 17/02*** | (2006.01) |
| ***G04B 15/06*** | (2006.01) |

(52) U.S. Cl.

CPC ..... *G04B 15/06* (2013.01); *G04B 17/02* (2013.01)

USPC ..... 368/134; 368/179

(58) Field of Classification Search

CPC ..... G04B 15/06; G04B 17/20

USPC ..... 368/134–138, 179–183

See application file for complete search history.

(56) References Cited

U.S. PATENT DOCUMENTS

| | | | | | |
|---|---|---|---|---|---|
| 26,150 | A | * | 11/1859 | Addy | 368/134 |
| 197,832 | A | * | 12/1877 | Davies | 368/137 |
| 633,938 | A | * | 9/1899 | Zimmerman | 368/136 |
| 739,245 | A | * | 9/1903 | Wlllmann | 368/136 |
| 1,178,922 | A | * | 4/1916 | Jacquemoud | 368/136 |
| 1,926,456 | A | * | 9/1933 | Riggs | 368/134 |
| 2,531,273 | A | * | 11/1950 | Jaccard | 368/127 |

* cited by examiner

*Primary Examiner* — Vit W Miska
(74) *Attorney, Agent, or Firm* — Perkins Coie LLP

(57) ABSTRACT

An enhanced escapement mechanism provides improved isolation of energy and torque for an oscillation system, e.g. a pendulum. In an exemplary embodiment, during a first phase, a pendulum releases an impulse arm that is decoupled from a main wheel, which falls and impulses the pendulum, such as at or near the middle of the pendulum swing. In a second phase, the impulse arm continues to fall, becoming totally detached from the pendulum, wherein the falling impulse arm releases the main wheel, which restores the impulse arm to its initial position. The main wheel continues to rotate until it is no longer in contact with the impulse arm, and is captured, such that the process may be repeated. While the enhanced escapement mechanism typically provides an impulse to an oscillation system during each period, alternate embodiments provide an impulse for each of a plurality of periods, e.g. once every ten periods.

16 Claims, 9 Drawing Sheets

TWO-PHASE DETACHED ESCAPEMENT MECHANISM FOR OSCILLATORS AND RELATED SYSTEMS

PRIORITY CLAIM AND CROSS REFERENCE TO RELATED APPLICATION

This Application claims benefit to U.S. Provisional Application No. 61/333,142, entitled Two-phase Detached Escapement, filed on 10 May 2010, which is incorporated herein in its entirety by this reference thereto.

BACKGROUND OF THE INVENTION

1. Technical Field

The invention relates to escapement mechanisms and related systems and processes. More particularly, the invention relates to escapement mechanisms and related systems and processes for oscillating systems, such as for but not limited to pendulums.

2. Description of the Prior Art

Historically, the gravity pendulum has been the most successful device for accurately regulating the timing of a mechanical clock. The frequency of such a simple pendulum is approximately proportional to the square root of the ratio of earth's gravity to length of the pendulum ($f=2\pi\sqrt{l/g}$). Because the force of gravity is reasonably constant, keeping the period constant is largely a matter of keeping the length constant, which can be accomplished by careful selection of the materials and geometry, while paying special attention to expansion due to changes in temperature.

While an idealized pendulum has all of its mass concentrated at a point, real pendulums are actually compound pendulums, with a distributed mass. In general, a compound pendulum has a longer period than a corresponding idealized pendulum, because of the extra moment of inertia contributed by the distribution of the mass.

Mechanical clocks commonly include an escapement mechanism to input a controlled amount of stored energy to a pendulum, wherein the stored energy typically comprises potential energy provided by a weight and/or a spring.

One problem with clock escapements is that there is normally some variability in the drive torque of the escape wheel, which can lead to variability in the energy applied to the pendulum. This can in turn lead to inaccuracies in the clock's ability to keep steady time.

One method of reducing this variability is delivering the impulse to the pendulum indirectly, through an intermediate energy storage device that delivers a more constant impulse. For example, in a typical gravity escapement, the torque from the escape wheel is used to lift a weight to a fixed height, and the dropping of that weight delivers the impulse. This isolates the strength of the impulse from the torque applied to the escapement, but it does not solve the problem entirely, because the energy that must be removed from the pendulum to release the escape wheel may still depend on the torque applied to the escapement.

While some prior systems have provided detachment systems that attempt to decouple energy that is input into a pendulum, some of these systems provide energy input at the end of a swing, which is subject to variability.

It would therefore be advantageous to provide an escapement mechanism that provides improved detachment of energy and torque to an oscillatory system.

The development of such an escapement mechanism would constitute a significant technological advance.

SUMMARY OF THE INVENTION

An enhanced escapement mechanism provides improved isolation of energy and torque for an oscillation system, e.g. a pendulum. In an exemplary embodiment, during a first phase, a pendulum releases an impulse arm that is decoupled from a main wheel, which falls and impulses the pendulum, such as at or near the middle of the pendulum swing. In a second phase, the impulse arm continues to fall, becoming totally detached from the pendulum, wherein the falling impulse arm releases the main wheel, which restores the impulse arm to its initial position. The main wheel continues to rotate until it is no longer in contact with the impulse arm, and is captured, such that the process may be repeated. While the enhanced escapement mechanism typically provides an impulse to an oscillation system during each period, alternate embodiments provide an impulse for each of a plurality of periods, e.g. once every ten periods.

DETAILED DESCRIPTION OF THE INVENTION

Figure 1:
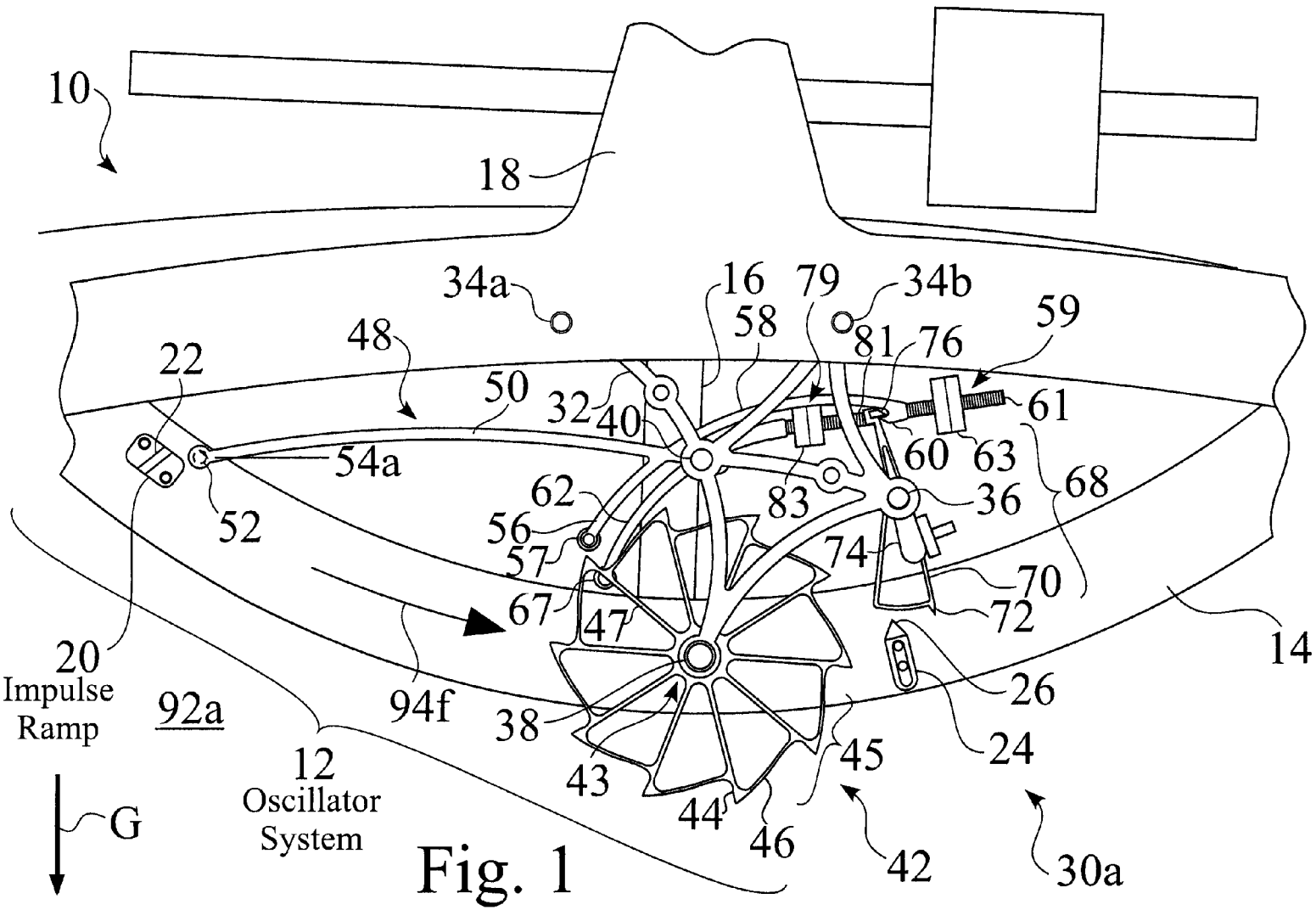
FIG. 1 is a partial view of a two-phase detached escapement mechanism for an oscillator in a first sequential position.

FIG. 1 is a partial cutaway view 10 of a oscillator system 12 having a two-phase detached escapement mechanism 30, e.g. 30*a*, wherein the escapement mechanism 30 is configured to deliver energy once for each back and forth swing of an exemplary oscillator, e.g. a pendulum 14, such that one impulse 102 (FIG. 2) is imparted to the pendulum 14 for each period 418 (FIG. 15) of the pendulum 14.

FIGS. 1 through 5 provide sequential views 92, e.g. 92*a*, 92*c*, 92*e*, 92*g*, 92*i*, of a periodic process 90 (FIG. 15, FIG. 16) of the exemplary two-phase detached escapement mechanism 30*a*, in conjunction with the periodic movement of a pendulum 14, and energy applied to the escapement mechanism 30*a* by an external source 146 (FIG. 4), e.g. a going train 146. For example, a going train 146, such as comprising but not limited to weights and/or springs, provides external energy to the pendulum 14, through the main wheel 42 of the escapement mechanism 30*a*.

Figure 2:
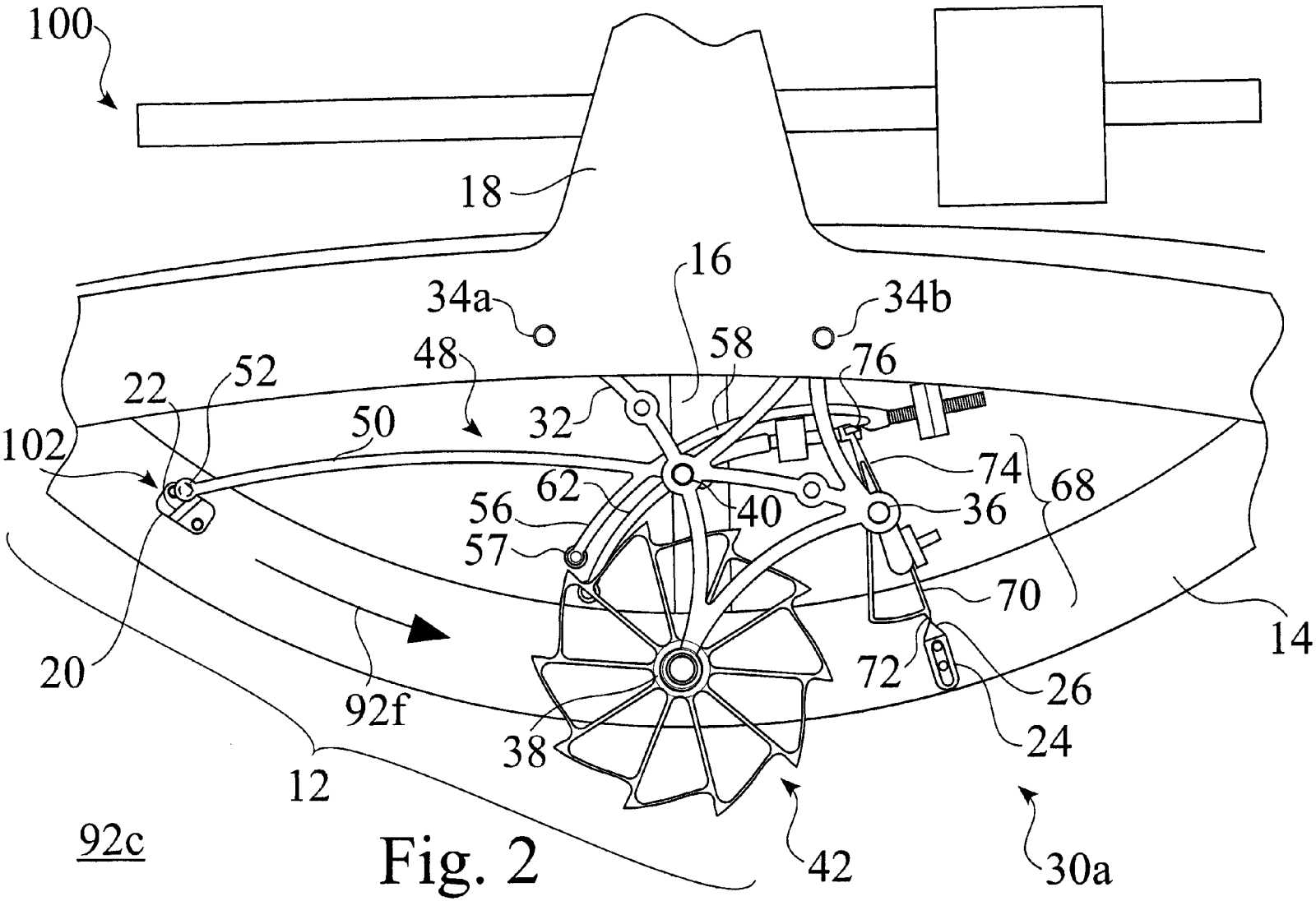
FIG. 2 is a partial view of a two-phase detached escapement mechanism for an oscillator in a second sequential position.

The exemplary oscillator system 12 seen in FIG. 1 comprises a pendulum 14, such as comprising but not limited to a generally circular shape, having an arm 16 that is pivotably mounted to a pendulum frame 18. The exemplary pendulum 14 is periodically swingable in relation to the frame 18, and has a maximum kinetic energy at the center of each forward stroke 94*f* or reverse stroke 94*r* (FIG. 5), e.g. when the exemplary pendulum arm 16 is at a vertical, i.e. 6 o'clock, position (FIG. 2).

The exemplary pendulum 14 seen in FIG. 1 also comprises an associated impulse ramp structure 20, wherein the impulse ramp structure 20 has a ramp surface 22 through which energy may be controllably applied to the pendulum 14 by the escapement mechanism 30*a*, through the coordinated movement of an impulse arm 48. While the impulse ramp 20 seen in FIG. 1 is shown as a discrete element that is attachable to the pendulum 14, the impulse ramp 20 may alternately be integrated with the pendulum 14.

The exemplary impulse arm 48 seen in FIG. 1 comprises arm members that extend from a pivot 40, comprising an impulse arm member 50 having an impulse contact 52, e.g. an impulse wheel 52, a holdback reset member 56 having a holdback contact 57, and a trigger catch member 58, having a trigger catch 60. The impulse arm 48, such as seen in FIG. 1, may further comprise a counterbalance mechanism 59, such as comprising a threaded member 61 and one or more threaded weights 63, wherein the balance of the impulse arm 48 may be set or adjusted.

Figure 15:
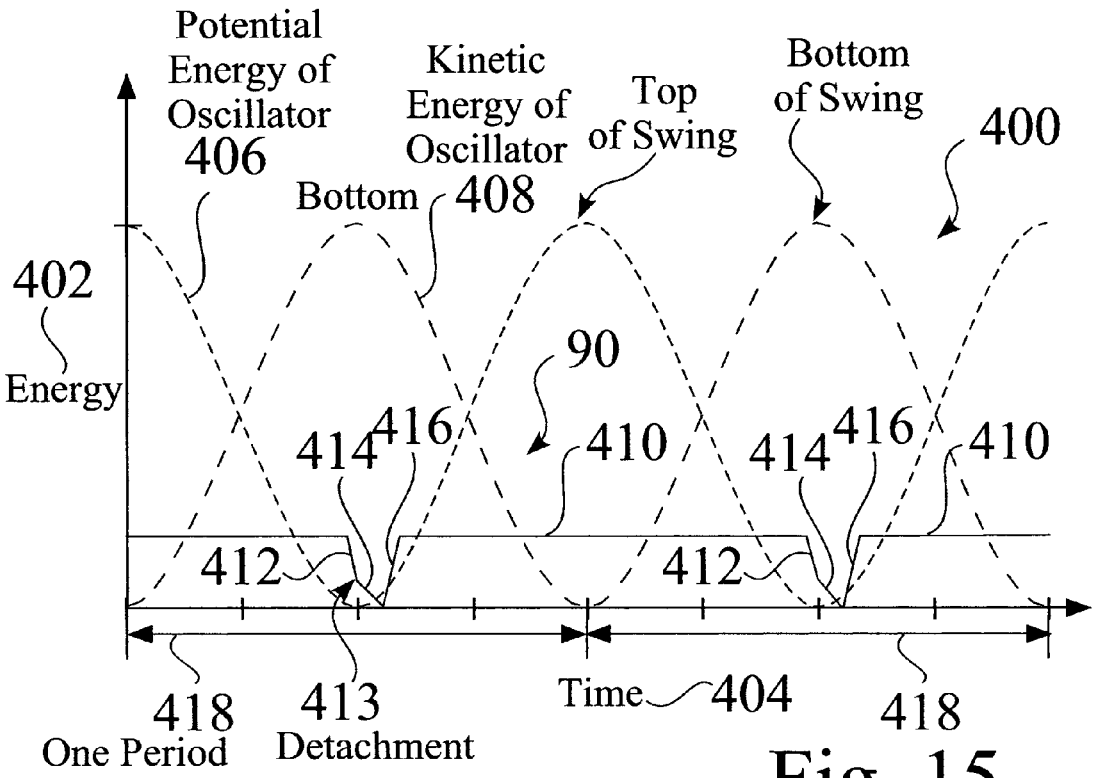
FIG. 15 is a chart that shows energy of a pendulum structure having a two-phase detached escapement mechanism.

The exemplary pendulum 14 seen in FIG. 1 further comprises a pendulum trigger pallet 24 having a corresponding trigger element 26, through which an impulse arm trigger assembly 68 of the escapement mechanism 30*a* is controllably triggered, through motion of the pendulum 14, to release the impulse arm 48 from a reset position 54*a*, i.e. a position having stored potential energy 410 (FIG. 15). While the trigger pallet 24 seen in FIG. 1 is shown as a discrete element that is attachable to the pendulum 14, the trigger pallet 24 may alternately be integrated with the pendulum 14.

The exemplary enhanced escapement mechanism 30*a* seen in FIG. 1 comprises an escapement frame 32 that is fixably mountable to the pendulum frame 18, such as through one or more attachment points 34, e.g. 34*a*,34*b*. The exemplary escapement frame 32 seen in FIG. 1 comprises one or more pivots, such as a main wheel pivot 38, an arm pivot 40, and a trigger pivot 36. In some embodiments of escapement mechanisms 30, one or more of the pivots 36,38,40 may comprise any of a bearing, a bushing, or a flexure. While the exemplary escapement frame 32 seen in FIG. 1 is shown schematically as a single frame 32, the escapement frame 32 may comprise two or more, e.g. opposing, frame members 52, such as to provide multiple points of support for any of the main wheel pivot 38, the arm pivot 40, or the trigger pivot 36.

As also seen in FIG. 1, the inner region 43 of a main wheel 42 is rotationally mounted to the escapement mechanism 30*a*, such as through the main wheel pivot 38. The exemplary main wheel 42 seen in FIG. 1 comprises ten teeth 44 having corresponding ramps 46 defined about an outer region 45, wherein each of the teeth 44 correspond to a rotation of 36 degrees for the main wheel 42 for each cycle of the escapement mechanism 30*a*. While the exemplary main wheel 42 seen in FIG. 1 comprises ten teeth 44, alternate embodiments of the main wheel 42 may comprise any number of teeth 44, based on the desired design, size, and performance of the escapement mechanism 30.

The impulse arm 48 seen in FIG. 1 is pivotably mounted 40 to the escapement frame 32. The impulse arm 48 extends from the pivot 40 to an impulse contact 52, e.g. an impulse wheel 52, which controllably imparts an impulse 102 (FIG. 2) to the pendulum 14 during the coordinated operation of the pendulum 14 and escapement mechanism 30*a*, when released from a position 54*a* having stored potential energy 410 (FIG. 15).

Figure 16:
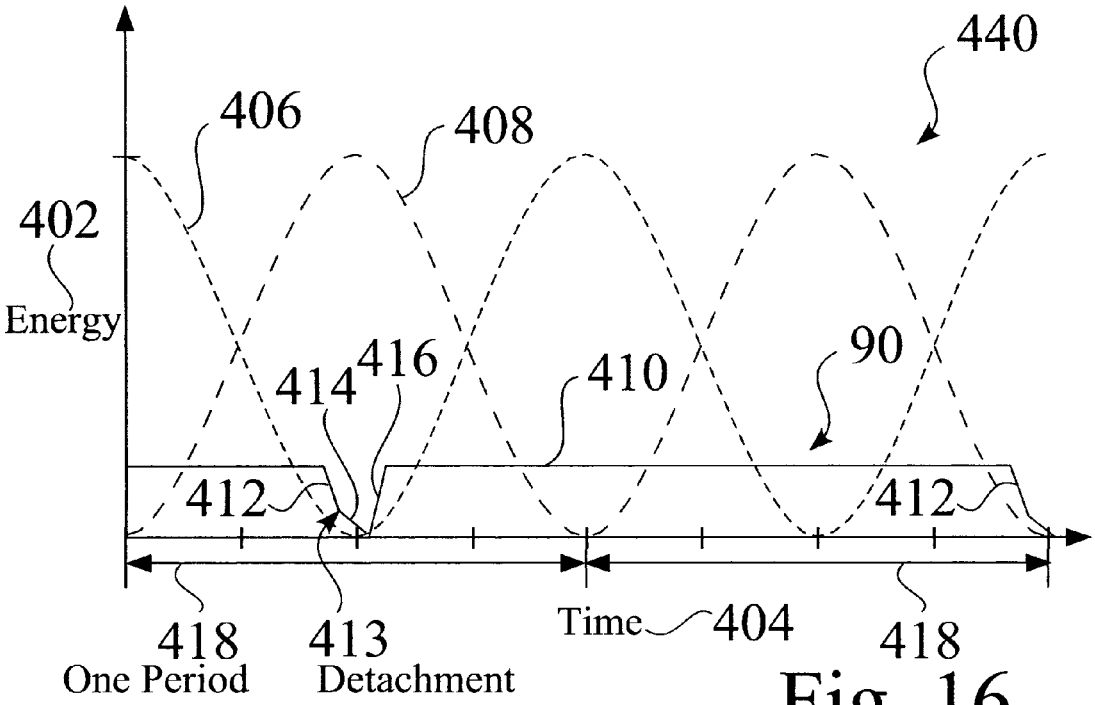
FIG. 16 is a chart that shows energy of a pendulum structure having a two-phase detached escapement mechanism, wherein impulse energy is applied once over a plurality of periods.

The stored potential energy 410 of the exemplary impulse arm 48, as shown in FIG. 15 and FIG. 16, is related to position 54, e.g. height, wherein upon release, the impulse arm 48 rotates about the pivot 40, such as due to gravity G, and imparts an impulse 102 upon the pendulum 14. Alternate embodiments of the enhanced escapement mechanism 30 may comprise a different energy storage mechanism, such as but not limited to any of a weight, a spring, or any combination thereof, and thus may not require a gravitational environment.

The enhanced escapement mechanism 30*a* seen in FIG. 1 also comprises a holdback arm 62 having a main wheel contact pin 67. The holdback arm 62 seen in FIG. 1 is pivotably mounted to pivot 40, and may further comprise a counterbalance mechanism 79, such as comprising a threaded member 81 and one or more threaded weights 83, wherein the balance of the holdback arm 62 may be set or adjusted. The exemplary impulse arm 48 and holdback arm 62 seen in FIG. 1 share the same axis 60, and may ride on different bearing structures or the same bearing structure.

The main wheel contact pin 67 of the holdback arm 62 seen in FIG. 1 is currently in contact with the main wheel 42, e.g. against a spoke 47 associated with one of the teeth 44. The holdback arm 46 keeps the main wheel 42 from rotating when the contact pin 67 is in contact with the main wheel 42. While the main wheel contact pin 67 may comprise any of a wide variety of shapes and materials, some current embodiments comprise a flat surface finger 67.

The enhanced escapement mechanism 30*a* seen in FIG. 1 also comprises a trigger mechanism 68, wherein movement of the pendulum 14 is used to trigger the escapement mechanism 30*a*, to release the impulse arm 48, and to initiate a reset at a time after the impulse 102 (FIG. 2) is completed. The exemplary trigger mechanism 68 seen in FIG. 1 operates as a one-way trigger, and comprises a first trigger element 70 having a trigger edge 72, and a second trigger element 74 having a trigger catch 76. The first trigger element 70 and the second trigger element 74 are rotatably mounted from a trigger pivot 36, such as with any of bearings, bushings or flexures.

FIGS. 1 through 5 provide sequential views 92, e.g. 92*a*, 92*c*, 92*e*, 92*g*, 92*i* of the process for operation 90 of the exemplary two-phase detached escapement mechanism 30*a* at different points in time 404 (FIG. 15).

For example, the escapement mechanism 30*a* seen in FIG. 1 is currently in a position 92*a*, wherein the impulse, i.e. gravity arm 48, which has previously been lifted to a height 54*a*, and is retained in this position by a hook 60 of the impulse arm 48 that is captured by a catch 76 of a trigger mechanism 68. The impulse arm 48 remains stationary through position 92*a*, until the pendulum 14 swings forward 94*f*, e.g. counterclockwise, to a position 92*c* (FIG. 2) wherein the trigger region 26 of the pendulum trigger pallet 24 contacts the trigger edge 72 of the first trigger element 70.

FIG. 2 is a partial view 100 of an enhanced escapement mechanism 30*a* for a pendulum 14 in a second sequential position 92*c*. In FIG. 2, the impulse arm 48 has been released by the trigger mechanism 68 due to movement of the pendulum 14, wherein it drops, rotating counterclockwise about the pivot 40, and delivering an impulse 102 to the pendulum 14 near the center of its forward swing 94*f*, such as by rolling the impulse wheel 52 along the impulse ramp surface 22. While some embodiments of the impulse arm 48 impart an impulse 102 may tap the impulse ramp surface 22, other embodiments may be configured to impart the impulse over a brief period of time 404, e.g. through an impulse wheel 52, such as to smoothly impart energy to the pendulum 14 over a brief duration of time 404. Furthermore, the size, shape, and/or angle of the impulse ramp surface 22 may be suitably configured, such as based upon desired impulse characteristics 102.

As seen in FIG. 2, as the pendulum 14 swings counterclockwise 94*f*, the trigger pallet 24 contacts the trigger edge 72 of the first trigger element 70, causing counterclockwise rotation 342 (FIG. 13) of the first trigger element 70 about pivot 36. Upon rotation 342, the first trigger element 70 makes contact 343 (FIG. 15) with the second trigger element 74, causing the second trigger element 74 to rotate counterclockwise 346 (FIG. 13), releasing the catch 76 of the second trigger element 74 from the hook 60 of the impulse arm 48. The impulse arm 48, once released, rotates counterclockwise and falls to deliver the impulse 102.

Figure 3:
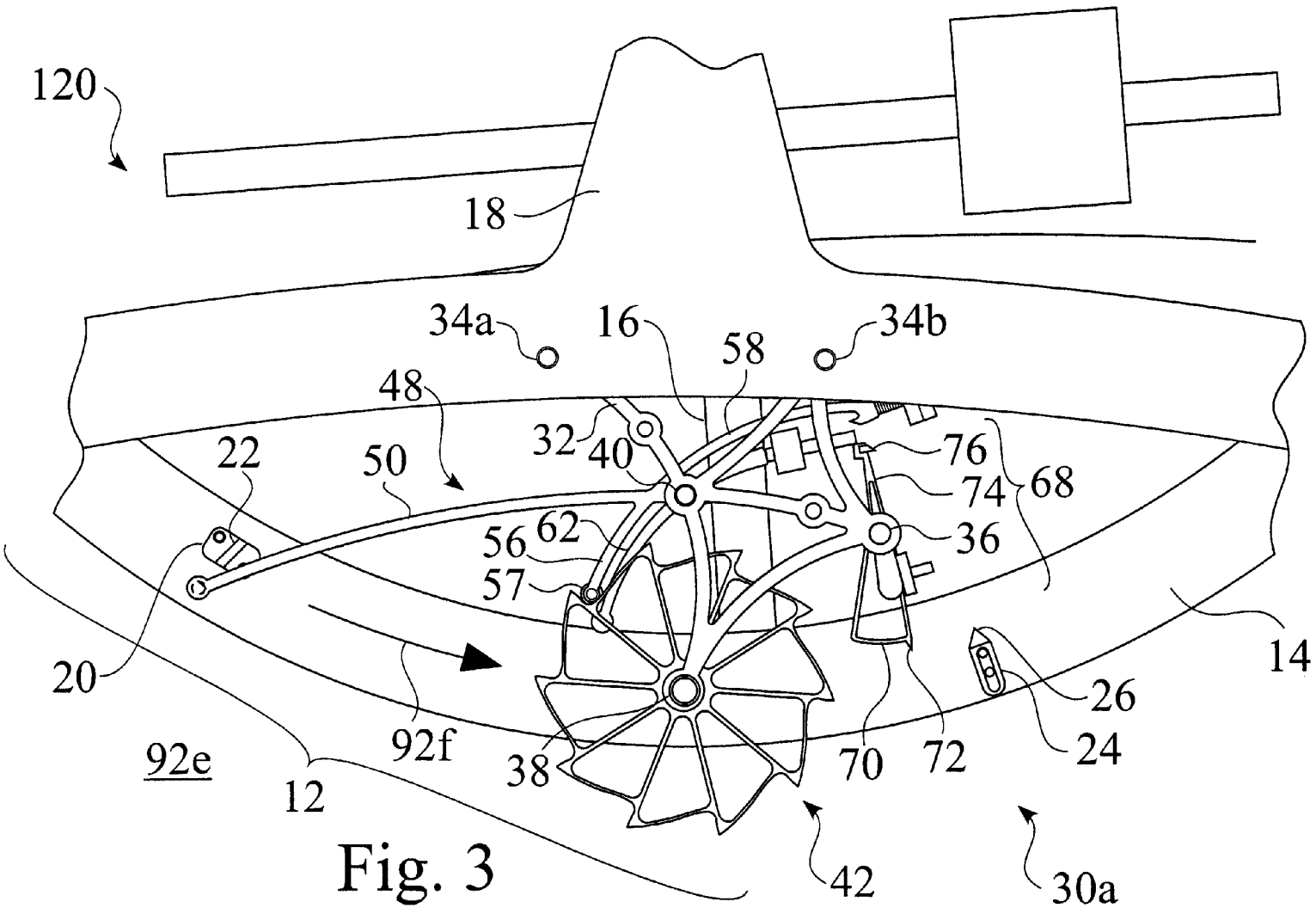
FIG. 3 is a partial view of a two-phase detached escapement mechanism for an oscillator in a third sequential position.

FIG. 3 is a partial view 120 of an enhanced escapement mechanism 30*a* for a pendulum 14 in a third sequential position 92*e*. In FIG. 3, the dropping impulse arm 48 has rotated further counterclockwise about pivot 40, and has finished delivering an impulse 102 to the pendulum 14, wherein the impulse wheel 52 has passed the impulse ramp surface 22. As seen in FIG. 3, the holdback reset member 56 of the impulse arm 48 has rotated counterclockwise about the pivot 40, wherein the holdback contact 57 makes contact with the holdback arm 62, thereby removing contact with and releasing the main wheel 42. As also seen in FIG. 3, the trigger mechanism 68 is currently not in contact with either the trigger pallet 24 or the impulse arm 48, wherein the first trigger element 70 and the second trigger element 74 have returned to a free resting position 336 (FIG. 12), wherein the first trigger element 70 and/or the second trigger element 74 may be configured, weighted, or mounted to rest in a position to recapture the impulse arm 48 as it rotates back when reset 416 (FIG. 15). For example, the first trigger element 70 and/or the second trigger element 74 may be pivotably mounted with at least one flexure having a desired resting position for receiving the impulse arm 48.

Figure 4:
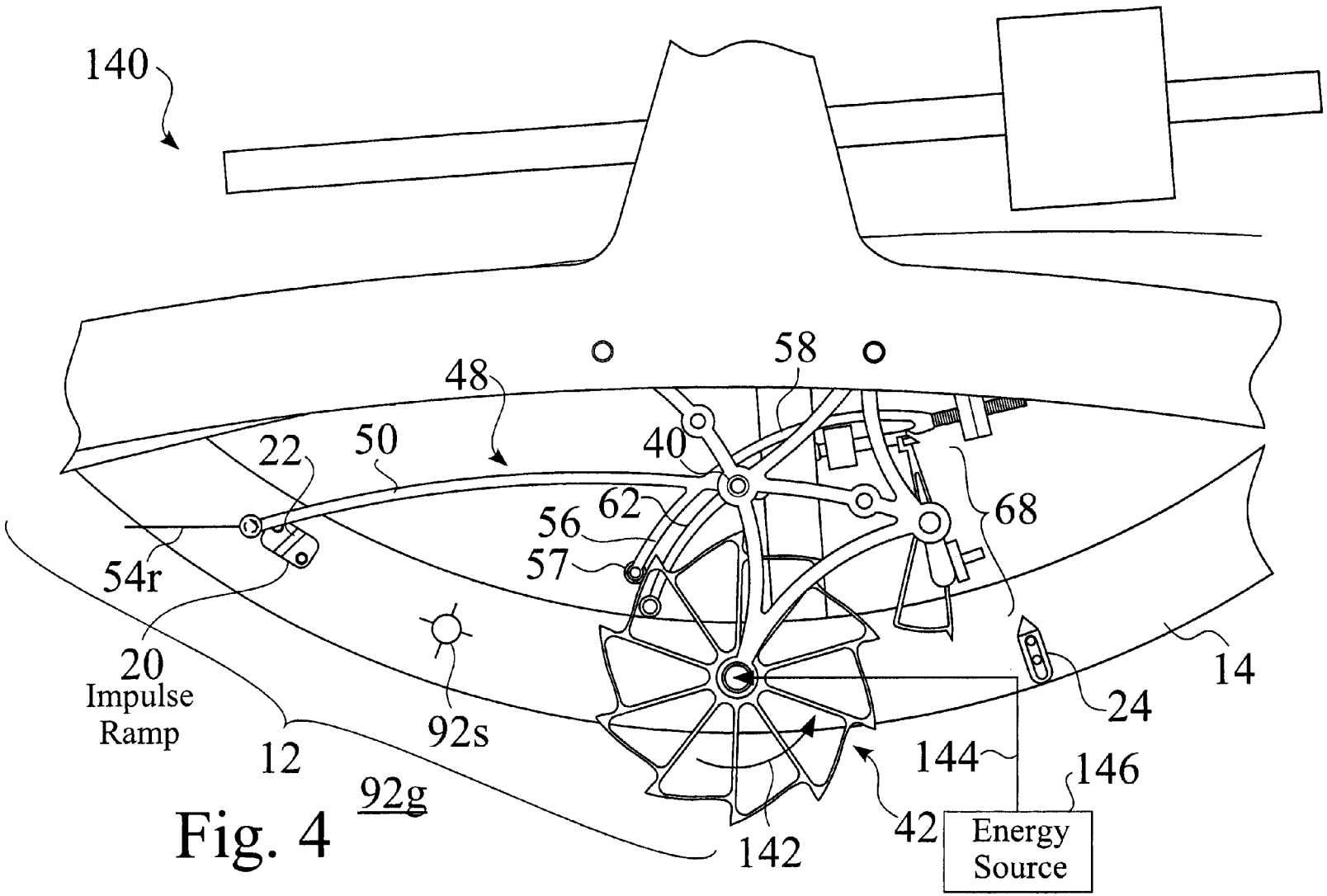
FIG. 4 is a partial view of a two-phase detached escapement mechanism for an oscillator in a fourth sequential position.

FIG. 4 is a partial view 140 of an enhanced escapement mechanism 30*a* for a pendulum 14 in a fourth sequential position 92*g*. As seen in FIG. 4, the holdback arm 62 is located at a position out of contact with the main wheel 42, wherein the main wheel rotates 142, e.g. counterclockwise, e.g. based on rotational energy input 144 to the main wheel axle 38 from an energy source 146, e.g. a going train 146. As the main wheel 42 rotates 142, the holdback contact 57, e.g. a reset wheel 57 of the holdback reset member 56 of the impulse arm 48, contacts the rotating ramp 46 of a proximate tooth 44, and is pushed by the ramp 46, thereby receiving potential energy through the ramp 46 and rotating the impulse arm 48 through position 54*r* to arrive at the reset position 54*a* (FIG. 1). During this motion, the trigger catch member 58 of the impulse arm 48 rotates clockwise about the pivot 40, wherein the trigger catch 60 approaches the catch 76 of the trigger mechanism 68.

Figure 5:
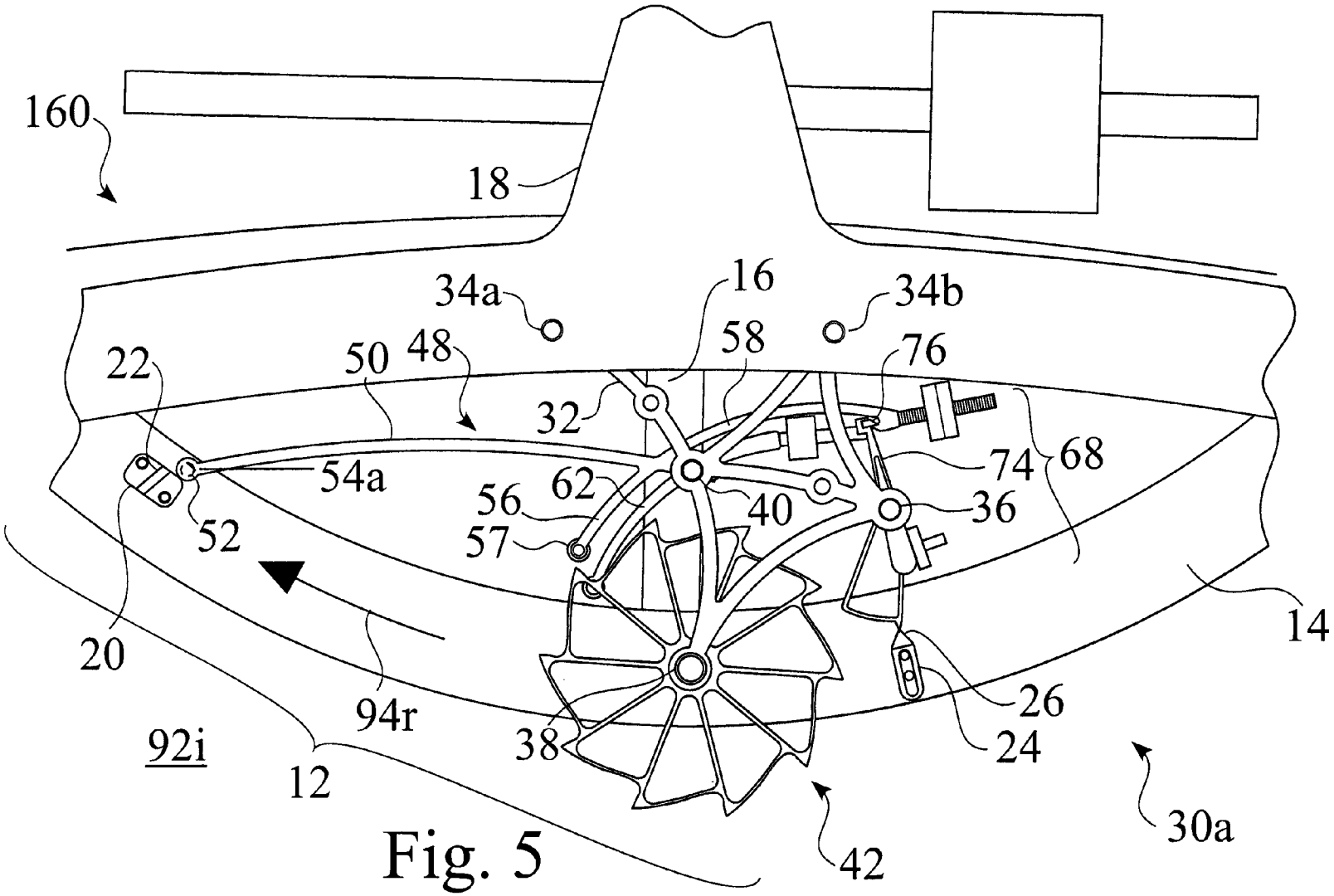
FIG. 5 is a partial view of a two-phase detached escapement mechanism for an oscillator in a fifth sequential position.

FIG. 5 is a partial view 160 of an enhanced escapement mechanism 30*a* for a pendulum 14 in a fifth sequential position 92*i*, wherein the pendulum 14 is currently swinging clockwise 94*r*. During the leftward, i.e. clockwise swing 94*r*, the pendulum trigger pallet 24 goes past the one-way trigger 68, without releasing either the impulse arm 48 or the main wheel 42. The periodic movement of the oscillator 14 and escapement cycle 90 then repeats 92*a*-92*k*.

The two-phase detached escapement mechanism 30 releases the main wheel 42 by utilizing the residual energy, e.g. the weight, of the impulse arm 48, after the impulse arm 48 has delivered its impulse 102 to the pendulum 14. Since the interaction with the main wheel 42 happens after the impulse arm 48 has delivered its impulse 102, the main wheel 42 is inherently prevented from affecting the intensity of the impulse 102.

Therefore, in a first phase 412 (FIG. 15), the pendulum 14 releases the impulse arm 48, which is decoupled from the main wheel 42, wherein the falling impulse arm 48 impulses 102 the pendulum 14. In a second phase 414 (FIG. 15), the impulse arm 48 continues to fall until it becomes totally detached from the pendulum 14, wherein the falling impulse arm 48 releases the main wheel 42, which restores the impulse arm 48 to the initial position 54*a*, and the main wheel 42 continues to rotate until it is no longer in contact with the impulse arm 48, and is caught by the holdback arm 62.

As noted above, alternate embodiments of the two-phase detached escapement mechanism 30 may utilize a different energy storage mechanism, such as a spring, which may be used instead of or in addition to the weight of the impulse arm 48.

Figure 6:
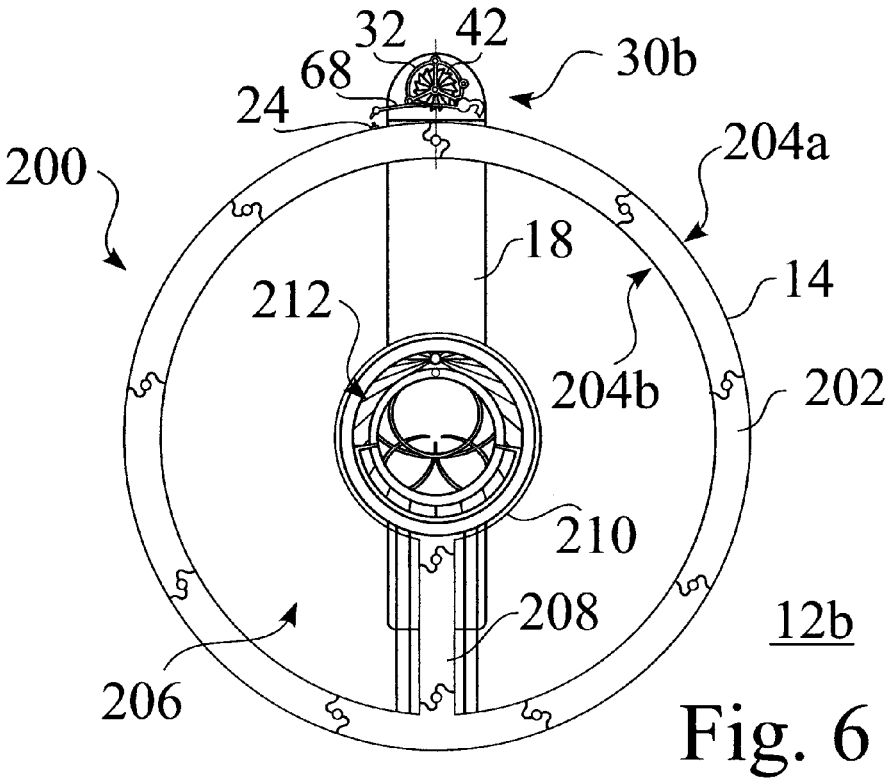
FIG. 6 provides a schematic view of a pendulum structure with a two-phase detached enhanced escapement mechanism.

FIG. 6 provides a schematic view 200 of an alternate pendulum structure 12, e.g. 12*b* with a two-phase detached escapement mechanism 30. The pendulum 14 seen in FIG. 6 comprises an outer ring 202, having an outer surface 204*a* and an inner surface 204*b*, and an inner region 206 defined within the ring 202. The pendulum 14 also comprises a support arm 208 that extends from the outer ring 202 to an inner support ring 210. The pendulum structure 12 seen in FIG. 6 further comprises a clock 212, and a two-phase detached escapement mechanism 30, e.g. 30*b*, which is mounted to a frame 18. The two-phase detached escapement mechanism 30*b* is mounted outside the ring 202, and is triggered by movement of a trigger pallet 24 that is located on the outer surface of the pendulum 14.

Figure 7:
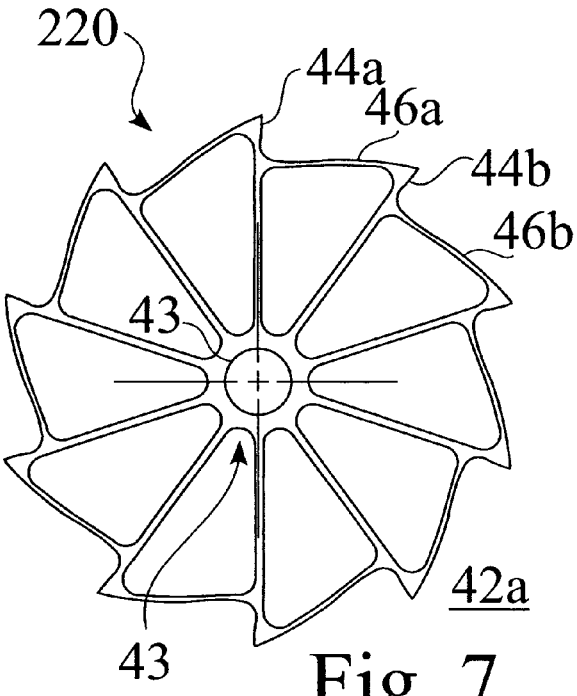
FIG. 7 is a detailed view of an exemplary main wheel for a two-phase detached escapement mechanism.
Figure 8:
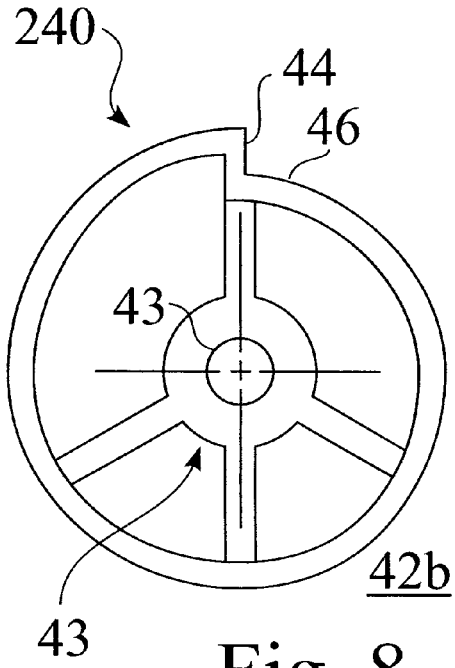
FIG. 8 is a detailed view of an alternate exemplary main wheel for a two-phase detached escapement mechanism.

FIG. 7 is a detailed view 220 of an exemplary main wheel 42, e.g. 42*a*, for an enhanced escapement mechanism 30. FIG. 8 is a detailed view 240 of an alternate exemplary main wheel 42, e.g. 42*b*, for an enhanced escapement mechanism 30. While the exemplary main wheel 42 seen in FIGS. 1 through 6 comprises ten teeth 44, alternate embodiments of the main wheel 42, e.g. 42*b*, may comprise any number of teeth 44, i.e. one or more, such as based upon the desired structures, design, and attached systems.

Holdback, Release and Reset Interactions.

Figure 9:
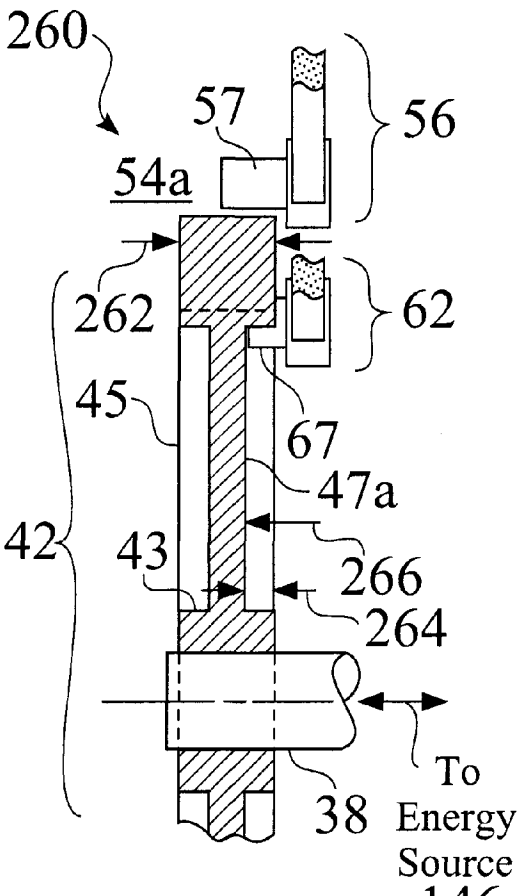
FIG. 9 is a first schematic view of interactions between a main wheel, a holdback arm, and a holdback reset member of an impulse arm.

FIG. 9 is a first schematic view 260 of interactions between a main wheel 42, a holdback arm 62, and the holdback reset member 56 of an impulse arm 48, such as consistent with the sequence 92*a* seen in FIG. 1, wherein the impulse arm 48 is held in a reset position 54*a*, before release to impart an impulse 102 on the impulse ramp 20 of the pendulum 14. As seen in FIG. 9, the spokes 47, e.g. 47*a*, are recessed 264 on the side of the main wheel 42 that is proximate to the holdback arm 62.

In the embodiment seen in FIG. 9, the width 262 of the outer region 45 of the main wheel 42 is larger than the width 266 of the spokes 47, e.g. 47*a*.

Figure 10:
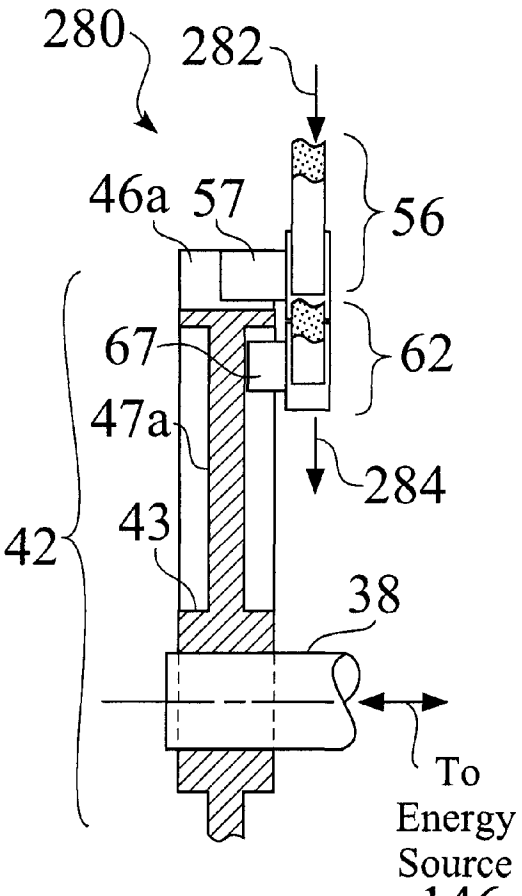
FIG. 10 is a second schematic view of interactions between a main wheel, a holdback arm, and a holdback reset member of an impulse arm.

FIG. 10 is a second schematic view 280 of interactions between a main wheel 42, a holdback arm 62, and the holdback reset member 56 of an impulse arm 48, such as approximately consistent with the sequence 92*e* seen in FIG. 3, wherein the impulse arm 48 has finished delivering an impulse 102 to the pendulum 14. After the impulse wheel 52 has passed the impulse ramp surface 22, the impulse arm 48 continues to rotate counterclockwise about the pivot 40, such that the holdback contact 57 makes contact and pushes 282 the holdback arm 62. This downward movement 282 causes the holdback arm 62 to move 284 toward the inner region 43 of the main wheel 42 and the axle mount 38, wherein the contact region 67 of the holdback arm 62 loses contact with the outer region 45 as it moves inward 284, such that the contact 67 enters the recess region 264 proximate to the spokes 47, thereby releasing the main wheel 42.

As also seen in FIG. 10, the holdback contact 57 of the holdback reset member 56 of the impulse arm 48 has approached a ramp 46, e.g. 46*a*, of the outer region 45 of the main wheel 42 during the downward movement 282. The released main wheel 42, driven by an energy source 146, e.g. a going train 146 of an oscillatory system 12, rotates 142, as seen in FIG. 4, and initiates upward resetting movement 302 (FIG. 11) of the impulse arm 48, back toward a reset position 54*a* (FIG. 5, FIG. 1).

Figure 11:
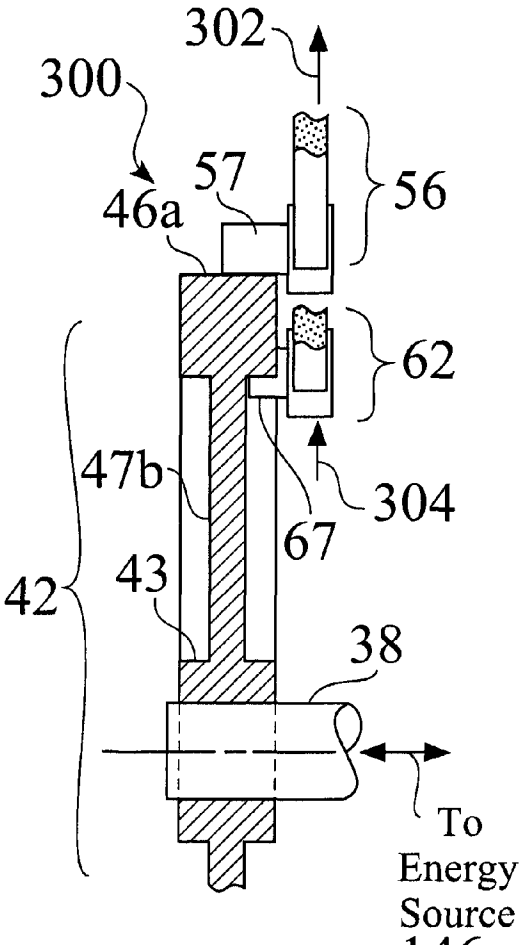
FIG. 11 is a third schematic view of interactions between a main wheel, a holdback arm, and a holdback reset member of an impulse arm.

FIG. 11 is a third schematic view 300 of interactions between a main wheel 42, a holdback arm 62, and the holdback reset member 56 of an impulse arm 48, such as approximately consistent with the end of the sequence 92*g* seen in FIG. 4, wherein the impulse arm 48 has been driven 302, e.g. upward 302, from the rotation 142 of a proximate ramp 46, e.g. 46*a*, toward a reset position, and wherein the holdback arm 62 also rotates upward 304, such that the contact 67 arrives and is captured by the next spoke 47, e.g. 47*b*. The upward rotation 304 of the holdback arm 62 is typically responsive to any of the balance of the holdback arm 62, or to an applied bias, e.g. such as due to any of a flexure used at pivot 40, or to another bias element, e.g. a spring.

One Way Trigger Arm for Escapement Mechanism.

Figure 12:
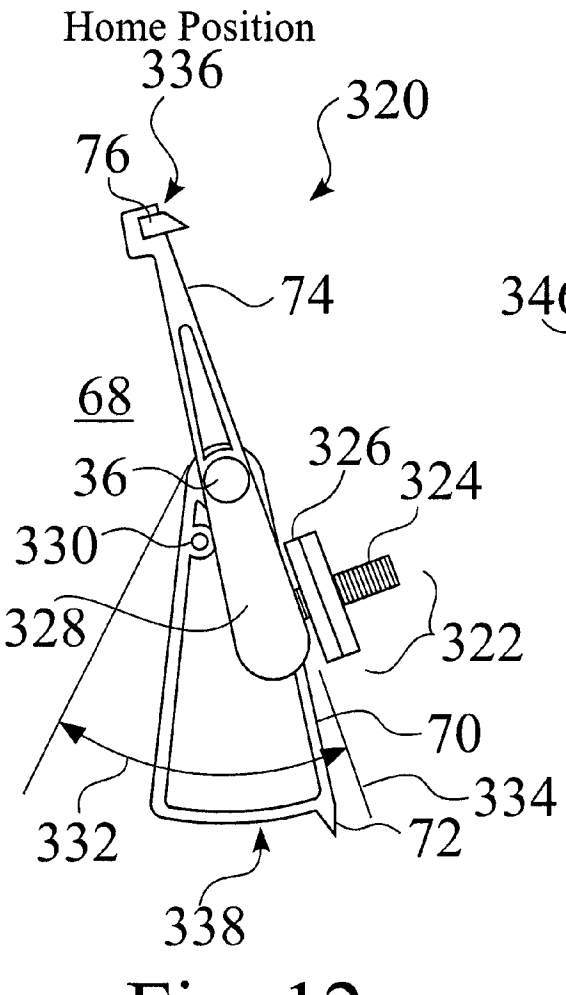
FIG. 12 is a first schematic view of interactions between a first trigger element and a second trigger element.

FIG. 12 is a first schematic view 320 of interactions between a first trigger element 70 and a second trigger element 74 for an exemplary one-way trigger mechanism 68 in an enhanced escapement mechanism 30, e.g. 30*a*. The positions of the first trigger element 70 and the second trigger element 74 seen in FIG. 12 are similar to that in FIG. 1, wherein both trigger elements 70,74 are pivotably mounted to a pivot mount 36, such as using any of a bearing, a bushing, or a flexure. The position of the second trigger element 74 is representative of a position wherein the trigger catch 74 captures and retains the hook 60 of the impulse arm 48, as seen in FIG. 1.

The second trigger element 74 seen in FIG. 12 may further comprise a counterbalance mechanism 322, such as comprising a threaded member 324 and one or more threaded weights 326, wherein the balance of the second trigger element 74 may be set or adjusted, and or may comprise a fixed counterweight 328, wherein, unless acted upon by the first trigger element 70, the second trigger element 74 may seek and remain in a home position 336.

The trigger mechanism 68 seen in FIG. 12 comprises means 330 for coordinated movement between the first trigger element 70 and the second trigger element 74, such as comprising any of a tab, pin or other detail 330, wherein a range 332 of allowable relative positions is established. For example, for the current relative positions of the first trigger element 70 and the second trigger element 74 as seen in FIG. 12, the first trigger element 70 is allowed a relatively small counterclockwise rotation 342 (FIG. 13) until it arrives at a relative position 334, at which point detail 330 contacts the second trigger element 74.

Figure 13:
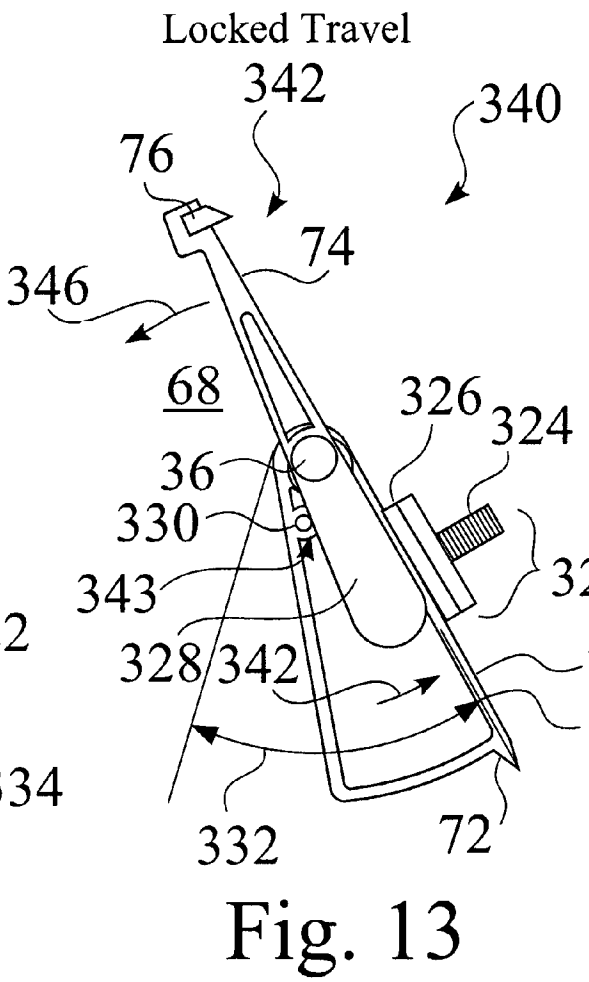
FIG. 13 is a second schematic view of interactions between a first trigger element and a second trigger element.

Further counterclockwise rotation of the first trigger element 70 results in coordinated counterclockwise rotation 346 (FIG. 13) of the second trigger element 74. For example, FIG. 13 is a second schematic view 340 of coordinated movement between a first trigger element 70 and a second trigger second trigger element 74. Once the first trigger element 70 arrives at the relative position 334, further counterclockwise rotation 342 of the first trigger element 70 results in counterclockwise rotation 346 of the second trigger element 70. As seen in FIG. 2, this movement 342, initiated by the clockwise rotation of the pendulum 14, and resultant clockwise movement of the trigger pallet 26 past the first trigger element 70, results in the release of the impulse arm 48.

Figure 14:
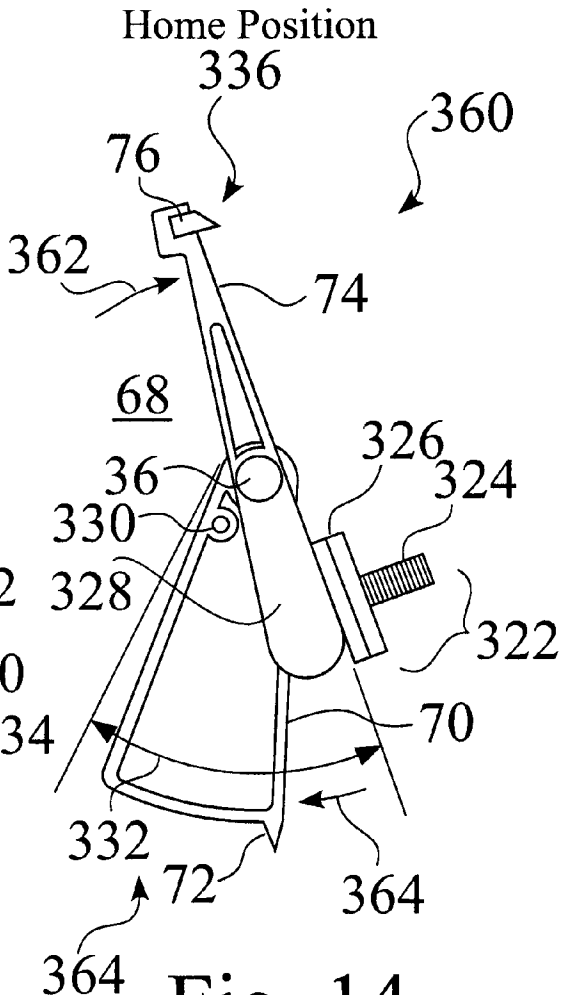
FIG. 14 is a third schematic view of interactions between a first trigger element and a second trigger element.

FIG. 14 is a third schematic view 360 of interactions between a first trigger element 70 and a second trigger element 74 for an exemplary one-way trigger mechanism 68 in an enhanced escapement mechanism 30, e.g. 30*a*. The positions of the first trigger element 70 and the second trigger element 74 seen in FIG. 14 are similar to that in FIG. 4 and FIG. 5. For example, the first trigger element 70 is free to rotate clockwise 364, such as to a rest position 338 (FIG. 12) or further 364 (FIG. 14) in response to clockwise contact with the trigger pallet 26 (FIG. 5). The second trigger element 74 is free to return clockwise 362 toward a home position 336, where it is positioned to recapture and retain the impulse arm 48.

Energy within Oscillator System having an Enhanced Escapement Mechanism.

FIG. 15 is a chart 400 that shows energy 402 as a function of time 404 of a oscillator structure 12, e.g. a pendulum structure 12, having a two-phase detached escapement mechanism 30. The potential energy 406 and the kinetic energy 408 are shown in FIG. 15 for the periodic motion 94 of an exemplary pendulum 14. The potential energy 410 for an associated two phase detached escapement mechanism 30 is also shown in FIG. 15, such as to show the stored potential energy at a reset position 54*a*, energy transfer during an impulse 102, energy transfer to the holdback arm 62 after the impulse 102 is complete, and energy transfer 416 back to the impulse arm 48 due to energy applied through the main wheel 42 to reset the impulse arm 42.

As seen in FIG. 15, the impulse 102 is applied when the pendulum 12 is in motion, such as at or near the center of motion, e.g. within 5 degrees, 10 degrees, or 20 degrees of the center of a swing 94, wherein the pendulum 12 is at or near a maximum velocity.

FIG. 16 is a chart 440 that shows energy 402 as a function of time 404 of a oscillator structure 12, e.g. a pendulum structure 12, having an alternate two-phase detached escapement mechanism 30, wherein impulse energy 102 is applied once over a plurality of periods 418, e.g. one impulse 102 for every X periods 418, where X>1. For oscillatory system 12 that have low energy loss over a large span of time, as compared to the periodic movement of an oscillator 12, it may be beneficial to limit energy input 102 only as needed. In such an embodiment, the reset of the impulse arm may preferably occur at one time, or may gradually occur, e.g. in periodic steps. The trigger mechanism 68 for such an embodiment may be controlled, such as mechanically or otherwise, to initiate energy transfer 102 once for each of a plurality of periods 418.

While the escapement mechanism is described herein with reference to a pendulum, it should be understood that the enhanced escapement mechanism and method for its use may readily be applied to a wide variety of oscillating structures. Furthermore, while the exemplary pendulum described herein may comprise a compound pendulum, enhanced escapement mechanisms and methods for their use may readily be applied to a wide variety of pendulum structures.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. An escapement mechanism for an oscillator structure having a fixed portion, and an oscillator that is pivotably attached to the fixed portion, comprising:

a main wheel that is attachable to an external source of rotational energy;

an impulse arm that is pivotably fixable in relation to the fixed portion of the oscillator structure, wherein the impulse arm is fixable in a reset position, wherein when in the reset position, the impulse arm has stored potential energy and is decoupled from the main wheel; and a trigger mechanism for releasing the impulse arm from the reset position;

wherein in a first phase, the trigger mechanism is configured to release the impulse arm, such that the impulse arm falls and impulses the oscillator; and wherein in a second phase, the impulse arm is configured to continue to fall away after impulsing the oscillator to become detached from the oscillator, and to release the main wheel, which is configured to rotate in response to the rotational energy, and restore the impulse arm to the reset position.

2. The escapement mechanism of claim 1, wherein the stored potential energy associated with the impulse arm is provided by any of a weight, a spring, or any combination thereof.

3. The escapement mechanism of claim 1, wherein the impulse is applied when the oscillator is at a maximum velocity.

4. The escapement mechanism of claim 1, wherein the impulse is applied when the oscillator is in motion.

5. The escapement mechanism of claim 1, wherein the impulse is applied when the oscillator is within at or near of its center of motion.

6. The escapement mechanism of claim 1, wherein the trigger mechanism comprises a first trigger element and a second trigger element, wherein the first trigger element is configured to pivotably move when contacted by the oscillator when the oscillator moves in a first direction or a second direction opposite to the first direction, and wherein the second trigger element rotates with the trigger pivot when the first trigger element rotates in the first direction, and wherein the second trigger element is detached from the first trigger element when the first trigger element rotates in the second direction.

7. The escapement mechanism of claim 1, wherein the trigger mechanism is configured to release the impulse arm based on movement of the oscillator.

8. The escapement mechanism of claim 1, further comprising:

a holdback arm that is pivotably fixable in relation to the fixed portion of the oscillator structure;

wherein the impulse arm is further configured to move the holdback arm to release the main wheel.

9. A process for delivering energy to an oscillator structure having a fixed portion, and an oscillator that is pivotably attached to the fixed portion, the process comprising the steps of:

providing an escapement structure comprising a main wheel that is attachable to an external source of rotational energy, an impulse arm that is pivotably fixable in relation to the fixed portion of the oscillator structure, wherein the impulse arm is fixable in a reset position, wherein when in the reset position, the impulse arm has stored potential energy and is decoupled from the main wheel, and a trigger mechanism for releasing the impulse arm from the reset position;

releasing the trigger mechanism to release the impulse arm, wherein the impulse arm falls and impulses the oscillator, and continues to fall after impulsing the oscillator to become detached from the oscillator, releases the main wheel, which rotates in response to the rotational energy, and restores the impulse arm to the reset position.

10. The process of claim 9, wherein the energy storage mechanism associated with the impulse arm comprises any of a weight, a spring, or any combination thereof.

11. The process of claim 9, wherein the impulse is applied when the impulse arm is at a maximum velocity.

12. The process of claim 9, wherein the impulse is applied when the impulse arm is in motion.

13. The process of claim 9, wherein the impulse is applied when the pendulum impulse arm is within 20 degrees of its center of motion.

14. The process of claim 9, wherein the trigger mechanism comprises a first trigger mechanism and a second trigger mechanism, wherein the first trigger mechanism is configured to pivotably move about the trigger pivot when contacted by the trigger pallet when the trigger pallet moves in either first direction or a second direction opposite to the first direction, and wherein the second trigger mechanism rotates about the trigger pivot when the first trigger mechanism rotates in the first direction, and wherein the second trigger mechanism remains stationary when the first trigger mechanism rotates in the second direction.

15. The process of claim 9, wherein the trigger mechanism is configured to release the impulse arm based on movement of the oscillator.

16. The process of claim 9, wherein the escapement structure further comprises a holdback arm that is pivotably fixable in relation to the fixed portion of the oscillator structure, wherein the impulse arm moves the holdback arm to release the main wheel.

* * * * *